US005388361A

United States Patent [19]

Farr

[11] Patent Number: 5,388,361

[45] Date of Patent: Feb. 14, 1995

[54] NIGHTSTICK WITH SHELL-FIRING MECHANISM

[75] Inventor: Thomas L. Farr, Burnsville, Minn.

[73] Assignees: James E. Alexander; Richard B. Alexander, both of New Brighton; Robert W. Alexander, Mahtomedi, all of Minn.

[21] Appl. No.: 215,630

[22] Filed: Mar. 22, 1994

[51] Int. Cl.[6] ..... F41H 9/10

[52] U.S. Cl. ..... 42/1.16; 42/2; 42/70.08

[58] Field of Search ..... 42/1.16, 1.08, 2, 69.01, 42/70.08

[56] References Cited

U.S. PATENT DOCUMENTS

| | | | |
|---|---|---|---|
| 1,026,609 | 5/1912 | Schwarzlose | 42/70.08 |
| 1,160,343 | 11/1915 | Tomaszewski | 42/1.16 |
| 1,598,784 | 9/1926 | Rae et al. . | |
| 1,858,601 | 5/1932 | Sedgley | 42/1.16 |
| 2,050,861 | 8/1936 | Rolston | 42/1.16 |
| 2,073,128 | 3/1937 | Wadsworth | 42/1.08 |
| 2,444,920 | 7/1948 | Davis, Jr. et al. | 42/1.16 |
| 2,634,535 | 4/1953 | Borders et al. | 42/1.16 |
| 3,298,125 | 1/1967 | Adrian et al. | 42/1.08 |
| 3,707,794 | 1/1973 | Rocha et al. | 42/1.16 |
| 3,721,032 | 3/1973 | Shum, Jr. et al. | 42/2 |
| 3,728,809 | 4/1973 | Mulich et al. | 42/1.16 |

*Primary Examiner*—Stephen M. Johnson
*Attorney, Agent, or Firm*—Haugen and Nikolai

[57] ABSTRACT

A nightstick and shell-firing device having a club portion and a handle portion. The club portion has an internal barrel, and the handle portion is movable to actuate a shell-firing mechanism contained within the handle portion. The shell-firing mechanism has a firing pin and trigger pivotally mounted to engage the firing pin, and a mechanical stop in the handle to pivotally release the trigger engagement when the handle is pulled rearwardly. A safety device that is quickly and easily manipulated is incorporated to prevent unintended firing of the shell.

18 Claims, 4 Drawing Sheets

NIGHTSTICK WITH SHELL-FIRING MECHANISM

BACKGROUND OF THE INVENTION

The present invention relates to a nightstick of the type utilized by law enforcement officers, having incorporated therein a shell-firing mechanism. More particularly, the present invention relates to a nightstick having an internal barrel, chamber and firing mechanism for firing shotgun shells through the barrel, wherein the firing mechanism is activated by manipulation of the handle of the nightstick.

A combination of a nightstick with a firearm device is known in the art, as evidenced by earlier-issued patents describing various specific forms of this combination. For example, U.S. Pat. No. 1,160,343, issued Nov. 16, 1915, discloses a combination club and firearm having a barrel and shell chamber, a slidable firing pin, and a spring-loaded plunger assembly for impacting against the firing pin to thereby cause the shell to fire. The shell is fired by pulling back the rear portion of the club handle against the force of a compression spring and suddenly releasing the handle to cause the plunger to spring forward in contacting relationship against the firing pin.

U.S. Pat. No. 1,858,601, issued May 17, 1932, discloses a combined club and firearm having a concealed trigger which may be pivotally extended outwardly to cause the firing mechanism to activate.

U.S. Pat. No. 2,073,128, issued Mar. 9, 1937, discloses a firearm which may be formed as a part of a nightstick, having a transversely slidable trigger mechanism mechanically linked to a firing pin, wherein the trigger may be pulled rearwardly and released, to cause the firing pin to impact against a shell.

U.S. Pat. No. 2,634,535, issued Apr. 14, 1953, discloses a combination club and cartridge firing mechanism, wherein the trigger mechanism is cocked by pulling a hammer which extends through the rear end of the handle to latch a lever locking mechanism. A trigger button on the side of the handle may then be depressed to disengage the latched locking mechanism and cause the firing pin to move forwardly into contact with the shell.

U.S. Pat. No. 3,707,794, issued Jan. 2, 1973, discloses a firing mechanism having a twistable sleeve incorporated with a firing ring, whereby twisting of the sleeve will permit a cocked firing pin mechanism to become released for contacting against a shell.

U.S. Pat. No. 3,728,809, issued Apr. 24, 1973, discloses a firing mechanism having a projecting trigger extension which may be engaged into a locking groove, and transversely moved out of the locking groove to permit release of the spring-loaded firing pin.

All of the foregoing patents disclose various forms of firing mechanisms which may be incorporated into a nightstick or the like. The firing mechanisms of these devices suffer from various deficiencies, including the need to manipulate a projecting trigger mechanism as in the '601 patent, the '128 patent, the '535 patent, and the '809 patent. The '343 patent relies upon a manually releasable trigger mechanism, wherein the firing pin force is dependent upon the release point of the handle, and wherein accidental firing may occur by impacting the base of the handle against a solid object. The '794 patent utilizes a trigger-cocking mechanism which becomes activated by threading the barrel onto the firing chamber mechanism, and firing is accomplished by rotating an exterior knurled sleeve to permit the firing pin to be released.

There is a need for a combination nightstick and firing mechanism which is devoid of any exterior trigger projections, and which may be positively held in a safety condition until firing is desired. Further, there is a need for a firing mechanism which may be simply and quickly activated by manipulation of the nightstick handle, without requiring manipulation of external trigger mechanisms.

SUMMARY OF THE INVENTION

The present invention comprises a combination nightstick and firing mechanism, having a firing pin which is cocked and released by a single rearward motion of the handle. The handle may be twisted to place the mechanism in a safety condition, and the safety may be released by a simple simultaneous actuation of a safety push button and a reverse twist of the handle. The firing mechanism includes a slidable hammer having a firing pin at its forward end, and having a raised annular shoulder at its rearward end. A pivotable lever has a sear for engaging against the annular shoulder, attached to a second slidable plunger which is retractable with an outer tubular handle. An internal stop limits the rearward movement of the pivotable lever, and causes the lever to pivot about its axis, thereby releasing the sear from engagement against the annular shoulder, to release the first plunger and firing pin to permit forward movement into contacting relationship with a shell.

It is the principal object of the present invention to provide a combination nightstick and firing device wherein the firing mechanism may be activated by a single motion.

It is a further object of the present invention to provide a nightstick and firing device having no externally projecting trigger mechanisms, or other features which might reveal its firing capabilities.

It is yet another object of the present invention to provide a combination nightstick and firing device having a positive safety position to prevent inadvertent firing of the device.

BRIEF DESCRIPTION OF THE DRAWINGS

The foregoing and other objects of the invention will become apparent from the appended specification and claims, and with reference to the drawings, in which:

DESCRIPTION OF THE PREFERRED EMBODIMENT

Figure 1:
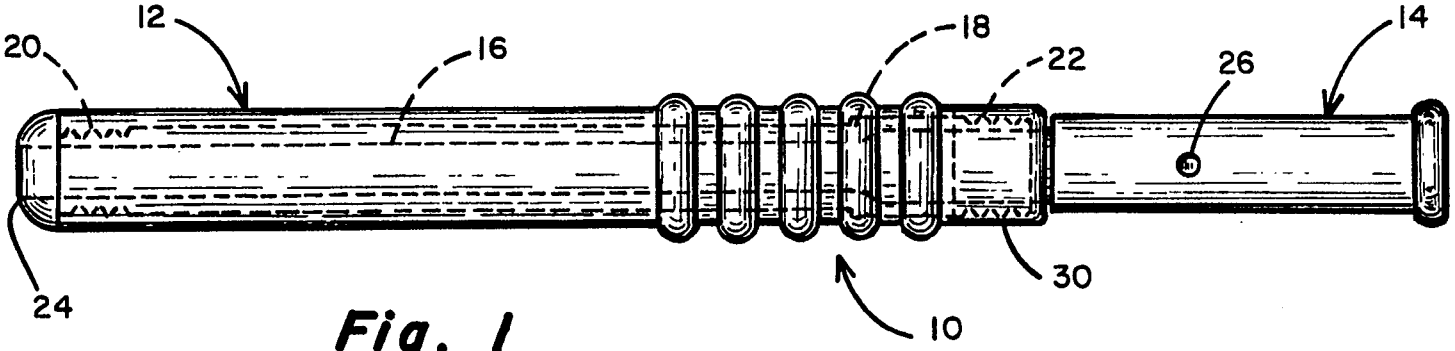
FIG. 1 shows an exterior view of one form of the invention.

FIG. 1 shows one form of a nightstick 10, having a club portion 12 and a handle portion 14. Nightstick 10 may be made from wood, metal or plastic material, or may be made from metal with an exterior plastic or rubberized cover. Nightstick 10 has an internal metal barrel 16, typically sized to accommodate a shell, which preferably is of 20-gauge shotgun variety. Barrel 16 has exterior threads on its forward end 20 for securing it into the interior of nightstick 10, and a threaded rearward end 22 for engagement by a knurled nut 30 which forms a part of handle 14. The rear end of barrel 16 is enlarged to form a shell chamber 18, and is preferably sized to accommodate a 20-gauge shotgun shell. To conceal the bore of barrel 16, the forward end of nightstick 10 may have a suitable cover 24 which is capable of either being easily ejected from nightstick 10 or ruptured upon the firing of a shell through barrel 16. Handle 14 has an access hole 26 in order to provide access to a lock screw 28 which will be hereinafter described.

Figure 2:
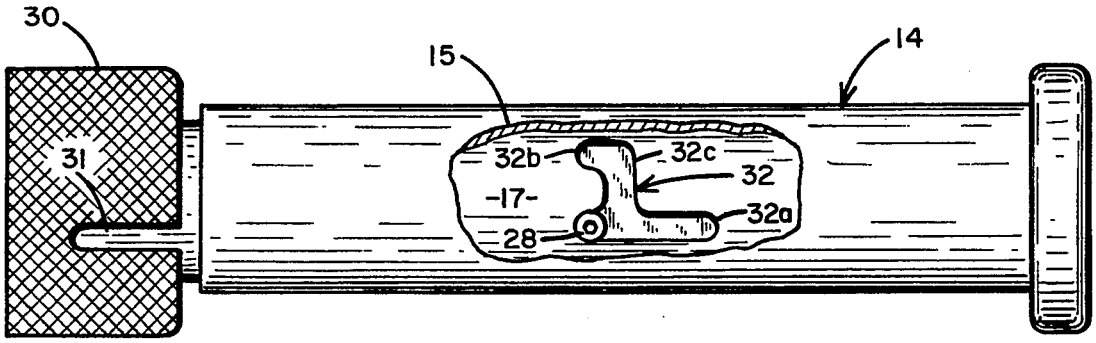
FIG. 2 shows the handle portion of one embodiment in partial cutaway.
Figure 3:
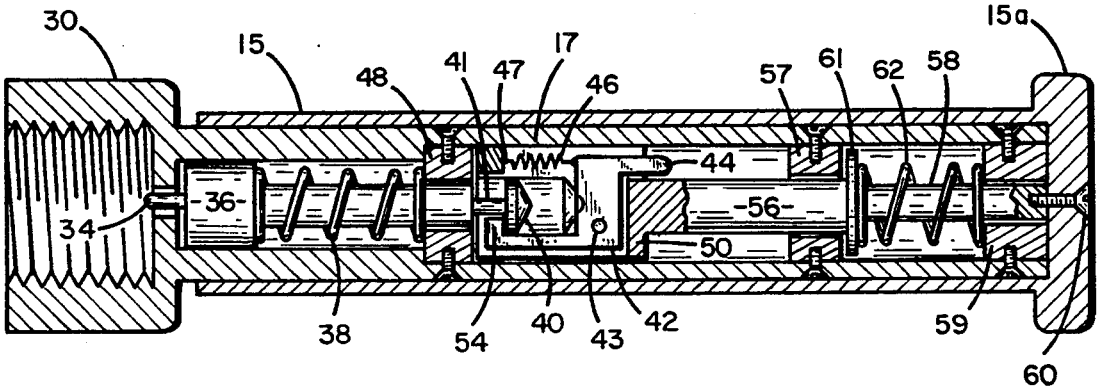
FIG. 3 shows a cross-sectional view of the handle portion of the embodiment of FIG. 2.
Figure 4:
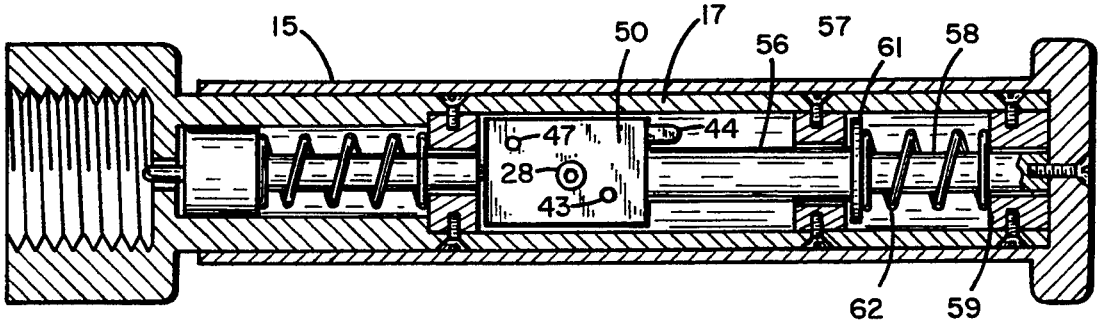
FIG. 4 shows the handle portion of the embodiment of FIGS. 2 and 3 in partial cross-section.

Referring next to FIGS. 2–4, handle portion 14 is shown in various cutaway and cross-sectional views. FIG. 2 shows handle portion 14 in partial cutaway, illustrating an outer tube 15 which fits over inner housing 17 sufficiently loosely so as to permit relative movement therebetween. An opening 26 (FIG. 1) through tube 15 permits access to lock screw 28. An "H" slot 32 in housing 17 provides a guide path for respective movement of the components, wherein lock screw 28 may be guided through the various channels formed by "H" slot 32. "H" slot 32 has an elongated slot portion 32*a* which corresponds to the firing position of the device; slot 32 has a shorter elongated portion 32*b* which corresponds to the "safe" or deactivated position; slot 32 has a transverse portion 32*c* which interconnects between slot portion 32*b* and slot portion 32*a*. A groove 31 is formed in knurled nut 30, in longitudinal alignment with elongated slot portion 32*a*; groove 31 serves as a visual identifier to permit a ready visual reference to enable the operator to determine whether the device is in a "safe" position or in a "fire" position.

Referring next to FIG. 3, handle portion 14 is shown in elevation cross-sectional view. Inner housing 17 is enclosed by outer tube 15, which has a rear expanded radial flange 15*a*. Outer tube 15 is rotatable about inner housing 17 and transversely movable relative to inner housing 17, to the degree permitted by the movement of lock screw 28 with "H" slot 32. Inner housing 17 has an internal chamber for containing the firing mechanism components associated with the device. A hammer 36 has a firing pin 34 formed at the forward end thereof. Hammer 36 extends rearwardly through a guide member 48, terminating in a hammer latch 40 which is supported on a neck 41. A firing spring 38 is compressed between guide member 48 and a shoulder on hammer 36, to provide a forwardly directed spring force against hammer 36. Guide member 48 is secured to housing 17 by means of appropriate fasteners.

Figure 5:
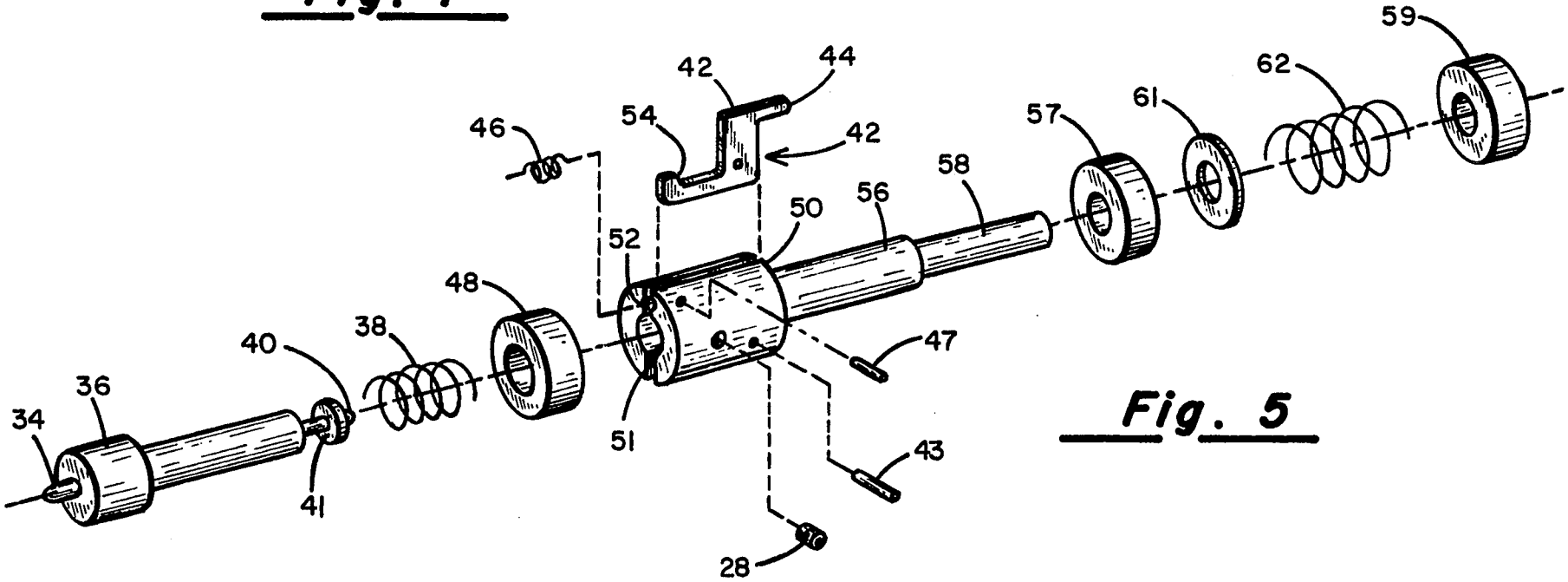
FIG. 5 shows an exploded view of the firing mechanism in the handle, for the embodiment of FIGS. 2–4.

A sear holder 50, best shown in FIGS. 4 and 5, is slidably contained within housing 17. Sear holder 50 has a forward opening sized to receive hammer latch 40, and a diametric slot 51 to receive firing lever 42. Firing lever 42 is pivotally connected to sear holder 50 in slot 51 by a pivot pin 43. Sear holder 50 also has a drilled hole 52 sized to accommodate a firing lever spring 46. A spring lock pin 47 holds firing lever spring 46 in compression, between lock pin 47 and firing lever 42. Spring 46 exerts a clockwise force against lever 42 about pivot pin 43, thereby holding contact head 44 in a rearwardly projecting pivotally position. At the same time, a sear 54 is pivotally urged upwardly into neck 41 and behind hammer latch 40. Sear 54 thereby holds hammer 36 in a fixed position relative to sear holder 50. Sear holder 50 is connected to outer tube 15 by means of lock screw 28, which is threadably secured to sear holder 50 and has an upwardly projecting shank to pass through opening 26 in outer tube 15.

A guide shaft 58 extends rearwardly from sear holder 50, and is slidably guided by center guide member 57. Center guide member 57 is affixed to housing 17 by appropriate fasteners. Guide shaft 56 has a reduced diameter portion 58 which passes through rear guide member 59. A fastener 60 is threadably attached to the reduced diameter portion 58, and serves to affix outer tube 15 to guide shaft 56 and sear holder 50. A compression spring 62 is constrained between rear guide member 59 and a washer 61.

The operation of the firing mechanism shown in FIGS. 2–5 will now be explained. Outer tube 15 is longitudinally movable relative to housing 17 over two limited distances, as determined by the relative position of lock screw 28 in H-slot 32. If outer tube 15 is twisted so as to place lock screw 28 into channel portion 32*b*, the range of transverse movement of outer tube 15 relative to housing 17 is restricted to practically no movement at all. When outer tube 15 is twisted so as to place lock screw 28 into channel portion 32*a*, there is a considerable range of transverse movement permitted. The following description assumes that lock screw 28 is positioned in channel portion 32*a*. As outer tube 15 is manually pulled rearwardly relative to housing 17, lock screw 28 and fastener 60 correspondingly pull sear holder 50, guide shaft 56 and reduced diameter portion 58 rearwardly. As sear holder 50 moves rearwardly, firing lever 42 moves rearwardly, and sear 54 pulls hammer latch 40 rearwardly. Firing spring 38 is compressed, as hammer 36 and firing pin 34 are correspondingly moved rearwardly. As rearward motion continues, contact head 44 contacts against center guide member 57, thereby causing firing lever 42 to pivot about pin 43. This pivoting motion causes sear 54 to disengage from hammer latch 40, thereby releasing hammer 36, and allowing it to move forwardly under the influence of firing spring 38. Firing pin 34 forcibly moves forwardly into shell chamber 18, to contact against the corresponding primer on a shell in chamber 18. This causes the shell to fire, ejecting the shell contents through barrel 16 and outwardly past cover 24. To reset the mechanism, outer tube 15 is returned automatically to its forward position, and knurled nut 30 may be threadably detached from barrel 18. After knurled nut 30 is detached from barrel 18, the spent shell may be removed from shell chamber 18 and replaced with a new shell, and handle portion 14 may again be threaded onto barrel 16 for a subsequent firing.

FIGS. 6–9 show an alternative embodiment of the invention, having a further safety feature to prevent unintentional discharge of a shell from the device. In this embodiment, an outer tube 115 is movable about an inner housing 117 in a manner similar to that described hereinbefore. Housing 117 has a forward knurled nut 130 for attachment to barrel 16. Outer tube 115 has an elongated slot 119, which guides a safety pin 121. Safety pin 121 is further guided by a "U" slot 132 which passes through housing 117. A lock screw 128 also passes through outer tube 115, and lock screw 128 is guided by an "L" slot 133 which passes through housing 117. Lock screw 128 is threadably secured against an inner cylinder 150 in a manner similar to that described hereinbelow.

Figure 6:
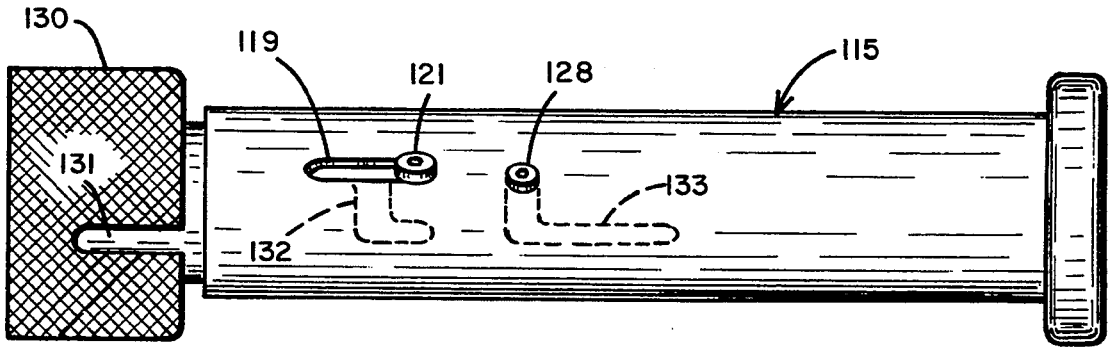
FIG. 6 shows the handle portion of a second embodiment of the invention.

When safety pin 121 is in the position shown in FIG. 6, the device is in a "safe" nonfiring condition. Outer tube 115 cannot be rotatably moved about housing 117, because safety pin 121 engages in one leg of "U" slot 132 to prevent such movement. Safety pin 121 is threadedly fastened into safety cylinder 202 (see FIG. 7), which is slidable within the interior of housing 117. Safety cylinder 202 is prevented from rearward sliding movement by spacer 148, and is resiliently biased against forward sliding movement by safety spring 203, which is engaged between safety cylinder 202 and safety slide tube 201. Safety slide tube 201 is held at the forward end of the interior of housing 117 by the forward wall of the housing. In order to activate the mechanism for firing, it is necessary to slide the safety pin 121 forwardly along slot 119 a short distance, to disengage from "U" slot 132, and then to transversely rotate handle tube 115 to engaged safety pin 121 in the leftmost leg of slot 132; i.e., in alignment with groove 131. The forward sliding of safety pin 121 is accomplished against the force of safety spring 203, and a transverse motion of safety pin 121 is accomplished by the rotatable motion of handle tube 115. Lock screw 128 correspondingly moves transversely when handle tube 115 is rotated, to move into the transverse elongated portion of "L" slot 133.

Figure 7:
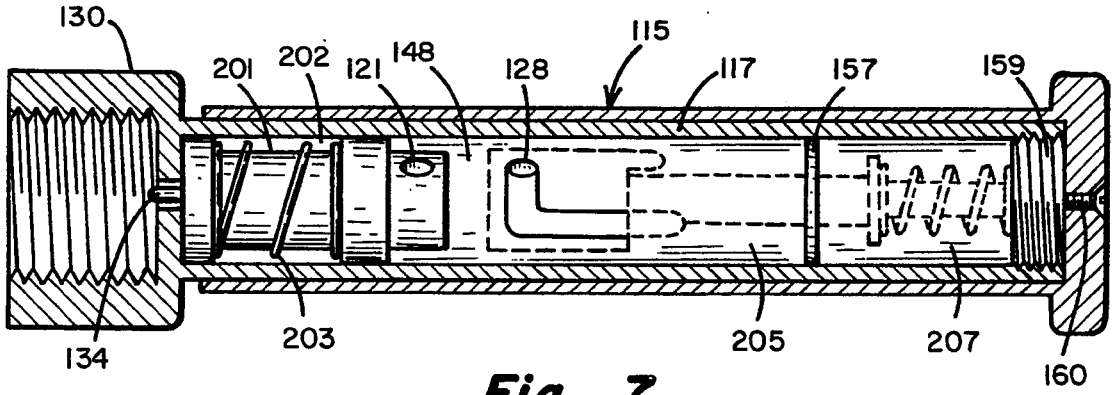
FIG. 7 shows a partial cross-section view of the handle of FIG. 6.

FIG. 7 shows a partial cross-section view of the interior of the handle section, illustrating the various tubular components which are found within housing 117. Safety cylinder 202 is slidable by manual activation of safety pin 121, over the outer surface of safety slide tube 201, against the force of compression spring 203. Spacer 148 is positioned adjacent safety cylinder 202, and a tubular spacer 205 is adjacent spacer 148. Tubular spacer 205 has an "L" slot corresponding identically to slot 133, guiding the travel path of lock screw 128. A spacer 157 is positioned adjacent tubular spacer 205, and a tubular end spacer 207 is adjacent spacer 157. A threadable rear lock nut 159 secures all of the components into the interior of housing 117.

Figure 8:
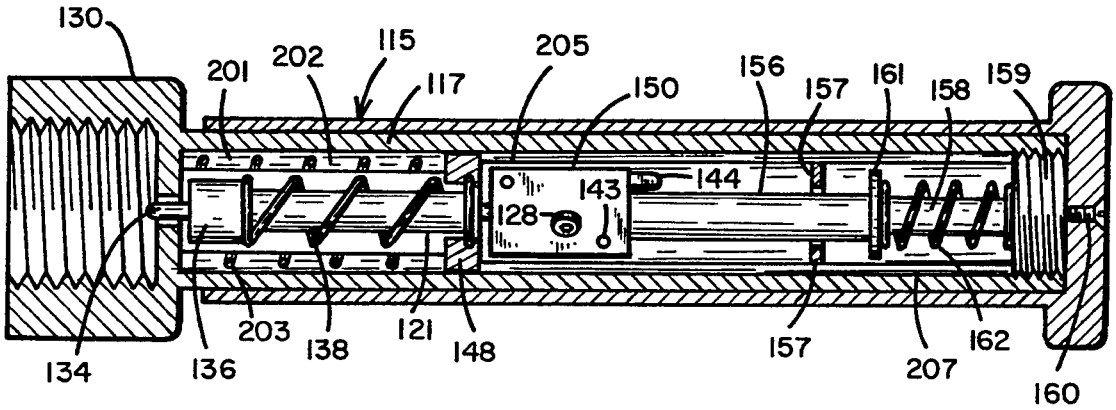
FIG. 8 shows the handle portion of FIG. 7 in further partial cross-section.
Figure 9:
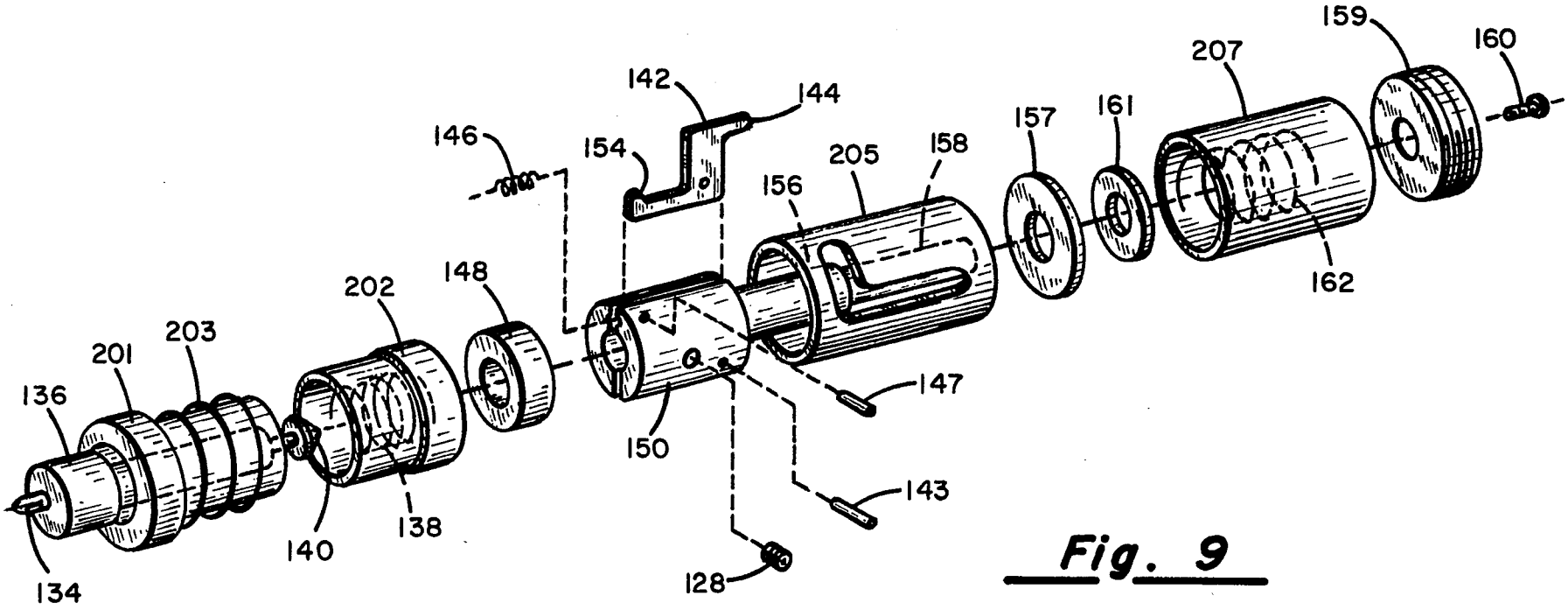
FIG. 9 shows an exploded view of the firing mechanism of the handle of FIGS. 6–8.

FIG. 8 shows a further cross-sectional view of the handle mechanism, illustrating the components which are slidable within the interior of the tubular members described with reference to FIG. 7. These interior components are similar to the interior components described with reference to FIG. 4, and include a firing pin 134 projecting from a hammer 136, and a firing spring 138 which surges the hammer and firing pin forwardly. The rear end of hammer 136 includes a hammer latch 140 which is received into an opening in sear holder 150. Reference should be made to FIG. 9 for a further illustration in exploded view of the components described herein. Sear holder 150 has a diametric slot which contains a firing lever 142 which is pivotable about a pin 143. Firing lever 142 has a sear 154 which is engageable with hammer latch 140, and a contact head 144 which is engageable against spacer 157. A firing lever spring 146 is transversely mounted in sear holder 150, and is compressibly held between a spring lock pin 147 and an edge of firing lever 142. The rear portion of sear holder 150 includes a guide shaft 156 and a reduced diameter portion 158. A compression spring 162 is held between a washer 161 and threadable lock nut 159. A fastener 160 is attached to the end of reduced portion 158, passing through threadable lock screw 159.

In operation, the device of FIGS. 6–9 operates similarly to the earlier-described device, with the further feature of a positive safety mechanism. When the outer tube 115 is in the position shown in FIG. 6, safety pin 121 serves as a positive safety to prevent firing of the mechanism. If safety pin 121 is manually moved forwardly along slot 119, and outer tube 115 is then rotated about housing 117, safety pin 121 will slide into a second leg of "U" slot 132, thereby placing the device in a firing mode. In this mode, when outer tube 115 is pulled rearwardly, cylinder 150 and hammer 136 are also pulled rearwardly. Rearward motion is guided by lock screw 128 in the elongated portion of slot 133. At a predetermined point in rearward travel the contact head 144 engages against spacer 157 to cause firing lever 142 to move pivotally about pivot pin 143. This causes sear 154 to disengage from contact with hammer latch 140, thereby permitting firing spring 138 to force hammer 136 forwardly. When hammer 136 moves forwardly, it causes firing pin 134 to enter the firing chamber, to thereby fire any shell residing therein.

The present invention may be embodied in other specific forms without departing form the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A nightstick and shell-firing apparatus comprising:

(a) a nightstick having a club portion and a handle portion, the handle portion being threadably attached to the club portion at one end thereof;

(b) a hollow barrel affixed inside said club portion, said barrel having a shell-receiving chamber proximate the end of said club portion which is threadably attached to said handle portion;

(c) a movable sleeve surrounding said handle portion, said sleeve being rearwardly slidable relative to said handle and club portions;

(d) a firing mechanism inside said handle portion, said firing mechanism linked to said movable sleeve, and comprising a firing pin movably positionable into said shell-receiving chamber, a pivotable trigger connected to said movable sleeve, said trigger having a sear for latching against said firing pin for rearward movement and a contact surface for pivotally releasing said sear; a first fixed stop in said handle portion engageable by said contact surface after predetermined rearward movement of said trigger; and a compression firing spring engageable between said firing pin and a second fixed stop in said handle portion;

whereby said sleeve may be moved rearwardly to cause compression of said firing spring, and at a predetermined rearward position said trigger pivotally releases said sear to permit said firing spring to force said firing pin into said shell chamber.

2. The apparatus of claim 1, wherein said firing mechanism further comprises a sear holder slidable in said handle portion, said sear holder being slidable with said sleeve, said sear holder having a transverse slot for pivotally mounting said trigger.

3. The apparatus of claim 2, further comprising spring means engaged between said sear holder and said trigger for urging said trigger means for latching toward said firing pin.

4. The apparatus of claim 3, wherein said firing mechanism further comprises a further compression spring engaged between said sear holder and said handle portion, said further compression spring urging said sear holder forwardly.

5. The apparatus of claim 1, wherein said handle portion further comprises a slot and said firing mechanism is linked to said movable sleeve by a pin passing through said slot.

6. The apparatus of claim 5, wherein said slot further comprises a first elongated portion to permit said sleeve to move said firing mechanism rearwardly sufficiently far to permit said trigger to pivotally release said sear, and a second elongated portion to limit said sleeve from said sufficient rearward movement to move said firing mechanism rearwardly, and a transverse slot portion between the first and second elongated portions; whereby said sleeve may be transversely turned to engage said pin in either said first elongated portion or said second elongated portion.

7. The apparatus of claim 4, wherein said sear holder further comprises a forward opening and said firing pin further comprises a rearward shoulder projecting into said opening; said sear engageable against said shoulder.

8. The apparatus of claim 7, wherein said sear further comprises a lip engageable against said shoulder.

9. The apparatus of claim 8, wherein said trigger contact surface further comprises a trigger extension leg projecting rearwardly outside said sear holder.

10. The apparatus of claim 9, further comprising an elongated cylinder extension extending rearwardly through said handle portion, said elongated cylinder extension being affixed to said movable sleeve.

11. A nightstick and shell-firing apparatus, comprising:

(a) a nightstick having a club portion, and a handle portion threadably attachable to said club portion;

(b) the interior of said club portion being formed into a hollow barrel having a shell-receiving chamber at the end threadably attachable to said handle portion, the other end of said barrel opening through the distal end of said club portion;

(c) the interior of said handle portion having a hollow bore with an end adjacent the shell-receiving chamber, said adjacent end having a small opening therethrough;

(d) a firing hammer slidably movable in said handle portion bore, said firing hammer having a firing pin which is projectable through said small opening into said shell-receiving chamber;

(e) a trigger mechanism slidably movable in said handle portion bore, said trigger mechanism including a sear for pivotally engaging and disengaging said firing hammer;

(f) a movable sleeve about said handle portion, said sleeve having means for connecting to said trigger mechanism;

(g) a fixed stop in said handle portion bore, positioned rearwardly of said trigger mechanism for pivotally engaging and disengaging said firing hammer, whereby contact by said trigger mechanism against said fixed stop causes disengagement of said firing hammer; and (h) a compression spring means for urging said firing hammer forwardly upon disengagement from said trigger mechanism.

12. The apparatus of claim 11, wherein said trigger mechanism further comprises a cylindrical sear holder having a forward opening sized to receive said firing hammer, said sear holder having a diametric slot partially therethrough; a trigger pivotally mounted in said diametric slot, said trigger having said sear engaging said firing hammer at one of its ends and having a contact surface projecting rearwardly at another of its ends.

13. The apparatus of claim 12, further comprising a first slot through said handle portion, and an opening through said sleeve alignable with said first slot, and a first screw threadably attached to said sear holder and passing through said first slot and said sleeve opening.

14. The apparatus of claim 13, further comprising a second slot through the said handle portion, and third slot through said sleeve alignable with said second slot, and a second screw passing through said second and third slots.

15. The apparatus of claim 14, wherein said first slot has a circumferential segment about said handle portion and a longitudinal segment parallel with said trigger mechanism direction of slidable movement, and said second slot is U-shaped with one leg of said U-shape being aligned with said first slot longitudinal segment.

16. The apparatus of claim 12, wherein said trigger mechanism further comprises a fixed tubular spacer about said firing hammer, a slidable tubular member about said fixed tubular spacer, and a compression spring engaged between said slidable tubular member and the handle portion end adjacent said shell-receiving chamber.

17. The apparatus of claim 16, further comprising a first slot through said handle portion, and an opening through said sleeve alignable with said first slot, and a first screw threadably attached to said sear holder and passing through said first slot and said sleeve opening.

18. The apparatus of claim 17, further comprising a second slot through said handle portion, and a third slot through said sleeve alignable with said second slot, and a second screw passing through said second and third slots and threadably attached to said slidable tubular member.

* * * * *